US008603262B2

(12) United States Patent
Lambert

(10) Patent No.: US 8,603,262 B2
(45) Date of Patent: Dec. 10, 2013

(54) CLEANING APPARATUS AND METHOD OF CLEANING A STRUCTURE

(76) Inventor: Roseanne Lambert, Chesapeake, VA (US)

( * ) Notice: Subject to any disclaimer, the term of this patent is extended or adjusted under 35 U.S.C. 154(b) by 354 days.

(21) Appl. No.: 12/847,424

(22) Filed: Jul. 30, 2010

(65) Prior Publication Data

US 2012/0024320 A1 Feb. 2, 2012

(51) Int. Cl.

| | |
|---|---|
| ***B08B 9/00*** | (2006.01) |
| ***B08B 7/00*** | (2006.01) |
| ***B03C 3/00*** | (2006.01) |

(52) U.S. Cl.

USPC ... 134/166 R; 134/93; 134/104.2; 134/167 R; 95/3; 95/58; 95/71; 95/78; 96/16; 96/52; 96/73

(58) Field of Classification Search

None

See application file for complete search history.

(56) References Cited

U.S. PATENT DOCUMENTS

| | | | | |
|---|---|---|---|---|
| 3,705,478 | A * | 12/1972 | Vaneldik et al. | 96/25 |
| 4,162,144 | A * | 7/1979 | Cheney | 95/58 |
| 5,561,527 | A * | 10/1996 | Krone-Schmidt et al. | 356/414 |
| 6,402,854 | B1 | 6/2002 | Horridge | |
| 6,468,360 | B1 * | 10/2002 | Andrews | 134/8 |
| 7,739,904 | B2 * | 6/2010 | Yokoi et al. | 73/114.56 |

FOREIGN PATENT DOCUMENTS

EP 46740 A2 * 3/1982

OTHER PUBLICATIONS

"Universal Air Products Electrostatic Precipitators" [online] [retrieved Oct. 4, 2010]. Retrieved from the Internet: <http://www.uapc.com/aircleaner.html>. 2 pages.

"Dry Ice Cleaning—Dry Ice Blasting" [online] [retrieved Oct. 4, 2010]. Retrieved from the Internet: <http:/bfsinc.org/>. 2 pages.

"Air Duct Cleaning by Clean Sweep Plus, Inc." [online] [retrieved Oct. 4, 2010]. Retrieved from the Internet: <http://www.cleansweepmn.com/air_duct_cleaning.html>. 2 pages.

"How to Clean Home Ducts and Vents" [online] [retrieved Oct. 4, 2010]. Retrieved from the Internet: <http://www.ehow.com/how_2077917_clean-home-ducts-vents.html>. 2 pages.

"How to Clean Air Conditioning Ducts" [online] [retrieved Oct. 4, 2010]. Retrieved from the Internet: <http://homeimprovement.superpages.com/heating+and+air/how-to-clean-air-conditioning-ducts.html>. 1 page.

"The Latest Ventilation Duct Cleaning Technology" [online] [retrieved Oct. 4, 2010]. Retrieved from the Internet: <http://www.dfdinstruments.co.uk/ProductTechnology/ventilationcleaning.htm>. 6 pages.

* cited by examiner

*Primary Examiner* — Nicole Blan

(74) *Attorney, Agent, or Firm* — Alston & Bird LLP

(57) ABSTRACT

A cleaning apparatus may include a flow source such as a fan which creates air flow through a ventilation duct or other structure to be cleaned. A projectile source projects projectiles such as dry ice pellets proximate the structure to dislodge debris particles therefrom and introduce the dislodged debris particles into the air flow. An electrostatic precipitator removes the particles from the air flow. An upstream sensor may be used to detect the particles upstream of the electrostatic precipitator and determine if the structure is clean using a controller. A downstream sensor may be used to detect the particles downstream of the electrostatic precipitator and determine the efficiency of the electrostatic precipitator using the controller. Carbon dioxide within the air flow may also be detected.

31 Claims, 5 Drawing Sheets

CLEANING APPARATUS AND METHOD OF CLEANING A STRUCTURE

FIELD OF THE INVENTION

Embodiments of the invention relate to a cleaning apparatus and associated methods. In particular, some embodiments of the invention relate to a cleaning apparatus that is configured to dislodge dust and other debris using projected dry ice and is further configured to collect such debris using an electrostatic precipitator.

DESCRIPTION OF RELATED ART

Certain structures are prone to collect dust, debris, and other particulate matter over time. For example, dust may build-up within a ventilation duct or similar structure causing a restriction of air flow through the duct, or otherwise undermining the effectiveness of the duct. The build-up of dust or other debris could also present health and cleanliness issues.

Applicant has identified a number of deficiencies and problems associated with the design and operation of conventional cleaning apparatuses which may be used to clean ducts and other structures. Through applied effort, ingenuity, and innovation, Applicant has solved many of these identified problems by developing a solution that is embodied by the present invention, which is described in detail below.

BRIEF SUMMARY OF THE INVENTION

Various embodiments are directed to a cleaning apparatus configured to clean debris particles from a structure such as an air duct. The cleaning apparatus may comprise a projectile source configured to project a plurality of projectiles proximate the structure to dislodge debris particles from the structure, a flow source configured to create an air flow for driving the dislodged debris particles from the structure, and an electrostatic precipitator configured to remove the dislodged debris particles from the air flow.

In an additional example embodiment, a cleaning apparatus configured to clean debris particles from a structure may comprise a projectile source configured to project a plurality of dry ice pellets proximate the structure to dislodge debris particles from the structure, a flow source configured to create air flow for driving the dislodged debris particles from the structure, and a carbon dioxide detector configured to detect carbon dioxide within the air flow.

In a further example embodiment a method of cleaning debris particles from a structure may comprise projecting a plurality of projectiles proximate the structure to dislodge debris particles from the structure, directing an air flow from the structure to drive the dislodged debris particles from the structure, and removing the dislodged debris particles from the air flow with an electrostatic precipitator.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

Figure 1:
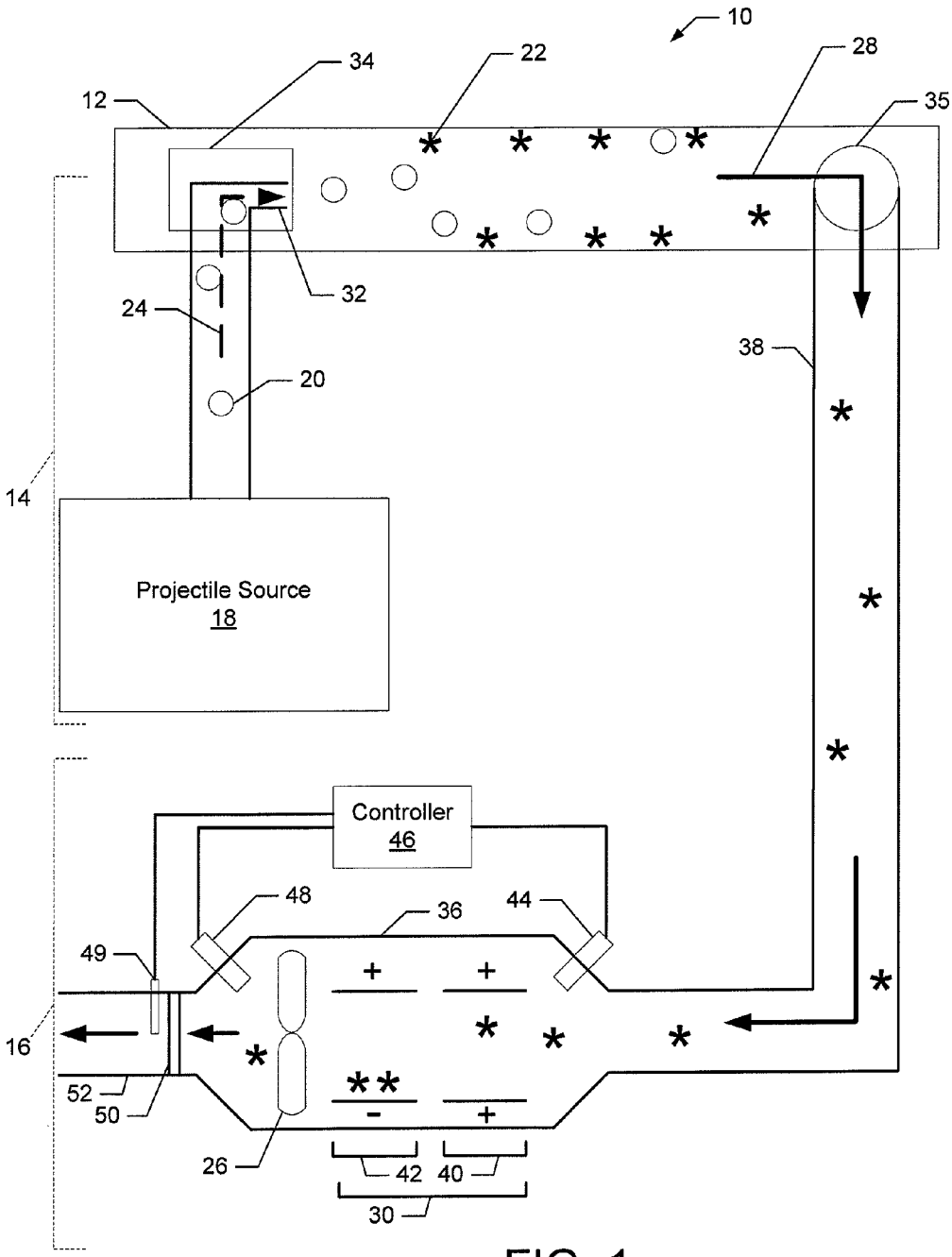
FIG. 1 illustrates a schematic view of a cleaning apparatus comprising an electrostatic precipitator according to an example embodiment.

FIG. 1 illustrates a cleaning apparatus 10 configured to clean a structure in accordance with one embodiment. The depicted cleaning apparatus 10 is shown cleaning a ventilation duct 12. However, the cleaning apparatus 10 may be used to clean a variety of structures (e.g., shipboard structures such as bilges, tanks, and voids, and commercial, residential, and industrial structures such as hallways, rooms, electronics, equipment, etc.), and hence the duct 12 is illustrated and described only for purposes of providing an example.

The cleaning apparatus 10 may comprise a debris removal device 14 and a debris collection device 16. The debris removal device 14 may comprise components that function to dislodge debris from the ventilation duct 12. Conversely, the debris collection device 16 may comprise components that function to collect the dislodged debris. Accordingly, embodiments of the cleaning apparatus 10 may clean the ventilation duct 12 or other structures while collecting the dislodged debris to remove built-up debris within such structures and limit contamination of the surrounding environment by the dislodged debris.

In some embodiments, the debris removal device 14 may be positioned upstream of the duct 12 and the debris collection device 16 may be positioned downstream of the duct 12 as shown. In various embodiments, the debris removal device 14 and the debris collection device 16 are disposed in fluid (e.g., air flow) communication with the duct 12 such that a flow path is created. In the depicted embodiment, the flow path begins generally proximate the debris removal device 14, travels through the duct 12, travels through the debris collection device 16, and terminates with an output flow to the environment.

The debris removal device 14 may comprise a projectile source 18 configured to project a plurality of projectiles 20 at or generally proximate to the duct 12 to dislodge a plurality of particles 22 (e.g., dust, debris) from the duct 12. As will be described in further detail below, in some embodiments, the projectiles 20 may comprise dry ice pellets (e.g., particles, fragments, etc.). In one embodiment, the projectiles 20 may be on the order of ⅛ inch in diameter, although various sizes and shapes of dry ice pellets may be used. The projectile source 18 may also comprise an ice box that stores crushed ice pellets and may further include a vibratory device that prevents the dry ice pellets from freezing to one another.

The projectile source 18 may comprise a compressed gas source (e.g., an air compressor, compressed gas cartridge, etc.) for creating a flow of pressurized gas 24 that facilitates expulsion of the projectiles 20 from the projectile source 18 and dispersal of the projectiles 20 proximate the duct 12. The pressurized gas 24 may in some embodiments comprise air, whereas in other embodiments various other types of gas may be used, such as carbon dioxide, nitrogen, etc. In one embodiment, the projectiles 20 are directed to a desired location (i.e., proximate a selected wall of the duct) using a user controllable wand 32 that may include a valve to turn on, turn off, or otherwise adjust the flow of projectiles 20 and pressurized gas 24 that is being expelled from the wand. In some embodiments, the wand 32 or other portion of the projectile source 18 may include a crusher comprising a grooved, spiraled, or baffled interior surface that breaks up the projectiles 20 into smaller pieces. In other embodiments, for example where delicate electronics are the structures to be cleaned, the projectile source 18 may comprise an ice shaver that shaves dry ice into a snow-like substance, and hence the crusher may not be used in such embodiments. Thus, various embodiments of the wand 32 may be selected accordingly.

Discharging dry ice pellets at a high velocity into the duct 12 in accordance with one embodiment of the invention may be particularly helpful for removing debris. The projectiles 20 may be introduced into the duct through an inlet access port 34 and exit the duct through an outlet access port 35. As the dry ice pellets enter the duct 12 they sublimate from a solid state to a gaseous state because air within the duct is at a temperature (e.g., ambient) that is much higher than the freezing point of carbon dioxide. While not intending to be limited by theory, energy released during sublimation combines with mechanical forces produced as the dry ice pellets (or fragments thereof) impact dust and debris build-up in ducts and enhances the dislodging effectiveness of the pellets beyond what is provided from their impact alone. In some embodiments, however, perhaps where maximum dislodging effectiveness is not required, the projectiles 20 may comprise various substances other than dry ice, such as other substances capable of sublimation.

With regard to collecting the dislodged debris particles 22, the debris collection device 16 may comprise a flow source 26 configured to create an air flow 28 that directs the particles out of the duct 12. The flow source 26 may push the air flow 28 through the duct 12 by being positioned upstream of the duct (not shown), or the flow source may pull the air flow through the duct by virtue of its positioning downstream of the duct, as shown in the illustrated embodiment. For example, in the depicted embodiment, the flow source 26 is a fan positioned within the debris collection device 16. In other embodiments, flow sources such as fans may be positioned at an alternate location (e.g., upstream of the duct 12) or at multiple locations along the flow path (e.g., upstream of the duct and downstream of the duct).

The debris collection device 16 comprises an electrostatic precipitator 30 that is configured to trap the dislodged particles 22. Thus, after the particles 22 are introduced into the air flow 28, the particles are driven (i.e., pushed or pulled) by the flow source 26 out of the duct 12 and eventually trapped in the electrostatic precipitator 30. Accordingly, the debris removal device 14 and the debris collection device 16 may remove and trap particles 22 that would otherwise contaminate the duct 12 or degrade its utility.

The depicted debris collection device 16 is connected to the outlet access port 35 of the duct 12 by a collection duct 38. In some embodiments, the collection duct 38 may connect to the duct 12 or other structure through use of a quick connect or other coupling device to facilitate attachment and removal of the collection duct 38. The collection duct 38 may comprise flexible tubing material, which may allow the collection duct 38 to be attached to a variety of different structures and may further enhance the portability of the cleaning apparatus 10. In the depicted embodiment, the collection duct 38 completes the flow path between the duct 12 and the debris collection device 16. In other embodiments, the debris collection device 16 may be connected directly to the duct 12 and, thus, the collection duct 38 may be omitted.

In one embodiment, debris particles 22 are introduced into the air flow 28 after being dislodged by the projectile source 18 and are driven (e.g., pushed or pulled depending on the position of the flow source(s)) by the flow source 26 through the collection duct 38 and then into the electrostatic precipitator 30. The electrostatic precipitator 30, which may be located in the plenum 36, is configured to remove the particles 22 from the air flow 28. In particular, the electrostatic precipitator may comprise an ionizer 40 and a collector 42. The ionizer 40 comprises wires (not shown) that impart a charge, e.g., a positive charge, to the particles 22. The collector 42 comprises plates (not shown) that carry an opposite charge, e.g., a negative charge, thus causing the charged particles 22 to collect onto the plates of the collector. The collector plates may be periodically removed and cleaned of the collected debris particles 22 as will be apparent to one of ordinary skill in the art in view of this disclosure.

In some embodiments, the debris collection device 16 may further comprise an upstream sensor 44 that is positioned upstream of the electrostatic precipitator 30. Upstream, as used herein, refers to a placement before a referenced member (e.g., the electrostatic precipitator 30 in the described embodiment) in reference to the normal air flow direction through the cleaning apparatus 10. Conversely, downstream, as used herein, refers to a placement after a referenced member (e.g., the electrostatic precipitator 30 in the described embodiment) in reference to the normal air flow direction through the cleaning apparatus 10.

In some embodiments, the upstream sensor 44 may be positioned at least partially within the plenum 36. The upstream sensor 44 may be configured to produce an upstream sensor output based at least in part on the relative presence or absence of dislodged debris particles 22 in the air flow 28 upstream of the electrostatic precipitator 30. Thus, in one embodiment, the upstream sensor output may generally correspond to a level, quantity, or density of debris particles 22 present in the air flow 28. By detecting the presence or quantity of debris particles 22 in the air flow 28 upstream of the electrostatic precipitator 30, the upstream sensor 44 may provide information that is useful during operation of the cleaning apparatus 10.

In one embodiment, the upstream sensor 44 may be a photo sensor that detects debris particle 22 quantities, densities, etc., by emitting and detecting a beam of light. If the beam of light is partially or fully blocked by the particles 22, then upstream sensor 44 may output a first value corresponding to relatively high debris particle quantity or density. If the beam of light is not blocked by the particles 22, then the upstream sensor 44 may output a second value corresponding to a relatively low debris particle quantity or density. In other embodiments, various other sensors for detecting the presence or absence of dust, debris, and other particulates may be used.

The cleaning apparatus 10 may further comprise a controller 46. The controller 46 may be configured to determine whether the duct 12 is clean by comparing the upstream sensor output to a predetermined threshold. For example, in some embodiments, the upstream sensor output may generally correspond to the quantity or density of the particles 22 in the air flow 28 upstream of the electrostatic precipitator 30, which the controller 46 may then compare to a predetermined threshold, which may also generally correspond to a quantity or density or other measurement of particles in the air flow. Further, in some embodiments the upstream sensor output may be recorded over a period of time and compared by the controller 46 to a predetermined threshold that generally corresponds to a quantity of particles per unit of time. Accordingly, the controller 46 may determine whether the duct 12 is clean by comparing the upstream sensor output with a predetermined threshold.

In some embodiments, the predetermined threshold may be related, at least partly, to an output value for a downstream sensor 48 positioned downstream of the electrostatic precipitator 30. In one embodiment, the downstream sensor 48 may be positioned at least partially within the plenum 36. The downstream sensor 48 may be configured to produce a downstream sensor output based at least in part on the relative presence or absence of dislodged debris particles 22 in the air flow 28 downstream of the electrostatic precipitator 30. In some embodiments, the downstream sensor 48 may comprise the same type of sensor as the upstream sensor 44 (e.g., photo sensor, etc.) while in other embodiments, the downstream sensor may be different than the upstream sensor. For example, in one embodiment, the downstream sensor may be more accurate than the upstream sensor in order to provide more accurate information regarding the quantity, density, size, etc., of debris particles that escape or bypass the electrostatic precipitator.

In another embodiment, the downstream sensor may comprise an altogether different type of sensor, for example, a carbon dioxide sensor that may be used to determine whether an undue level of carbon dioxide is present in the air flow. Alternatively or additionally, the cleaning apparatus 10 may further comprise a flow sensor 49. The flow sensor 49 may comprise a mass air flow (MAF) sensor in some embodiments, or other type of sensor configured to produce an output indicative of the flow of gas through the cleaning apparatus 10. The flow sensor 49 may be positioned in the debris collection device 16, for example a position downstream of the flow source 26. As will be apparent to one of skill in the art in view of this disclosure, it may be desirable to position the flow sensor in an air stream having reduced turbulence so as to encourage accurate readings.

In embodiments in which the cleaning apparatus further comprises a carbon dioxide sensor, the controller 46 may receive outputs relating to the amount of flow through the cleaning apparatus 10 and the concentration of carbon dioxide in the flow of gas. Thus, the controller 46 may calculate the amount of carbon dioxide traveling through the cleaning apparatus 10, and may, in some embodiments, compare the amount of carbon dioxide traveling through the cleaning apparatus to an expected amount of carbon dioxide based on the amount of projectiles 20 directed into the duct 12. The controller may thus determine whether or not carbon dioxide gas is undesirably escaping or building up in the duct 12.

By providing the downstream sensor output that may correspond to the quantity, density, or other debris particle 22 measurement, the cleaning apparatus 10 may determine to what extent debris particles 22 are traveling through or bypassing the electrostatic precipitator. Said differently, the controller 46 may be configured to determine the efficiency of the electrostatic precipitator 30 by comparing the upstream sensor output to the downstream sensor output. For example, if the upstream sensor output indicates a debris particle density that is substantially equal to the debris particle density indicated by the downstream sensor output, then the controller 46 may indicate to the user that the electrostatic precipitator is inoperable or needs to be cleaned. In another embodiment, the controller 46 may compare the downstream sensor output to a predetermined threshold value. In this example, if the downstream sensor output exceeds the predetermined threshold, then the controller 46 may determine that the electrostatic precipitator 30 needs to be cleaned.

In still another embodiment, the cleaning apparatus 10 may further include a bypass collector 50 downstream of the electrostatic precipitator 30. The bypass collector 50 may be configured to catch, or otherwise indicate the presence of, debris particles 22 that bypass the electrostatic precipitator 30 such as by traveling through the electrostatic precipitator without being captured. In some embodiments, the bypass collector 50 may comprise a filter, such as a high efficiency particulate air (HEPA) filter. In some embodiments, the bypass collector 50 may be used instead of the downstream sensor 48 while, in other embodiments, the bypass collector may be provided in addition to the downstream sensor as a secondary indicator that particles 22 are bypassing the electrostatic precipitator 30. In one embodiment, users can simply inspect the bypass collector 50 to determine whether particles 22 have bypassed the electrostatic precipitator 30 while, in other embodiments, a differential pressure sensor could be used to indicate significant bypasses of the electrostatic precipitator 30 (i.e., pressure differentials caused by clogging any filter used as a bypass collector).

In another embodiment, the debris collection device 16 may further comprise a discharge conduit 52 that is in fluid communication with the electrostatic precipitator 30. The discharge conduit 52 may be configured to discharge the air flow 28 to an external environment, for example, an outdoor environment. Discharging the air flow 28 to an outdoor environment may be useful in embodiments in which the projectiles 20 comprise dry ice pellets because when the dry ice pellets sublimate, they convert to carbon dioxide gas. Accordingly, exhausting the air flow 28 to an outdoor environment may limit user exposure to the carbon dioxide gas created by the sublimation process.

Figure 2:
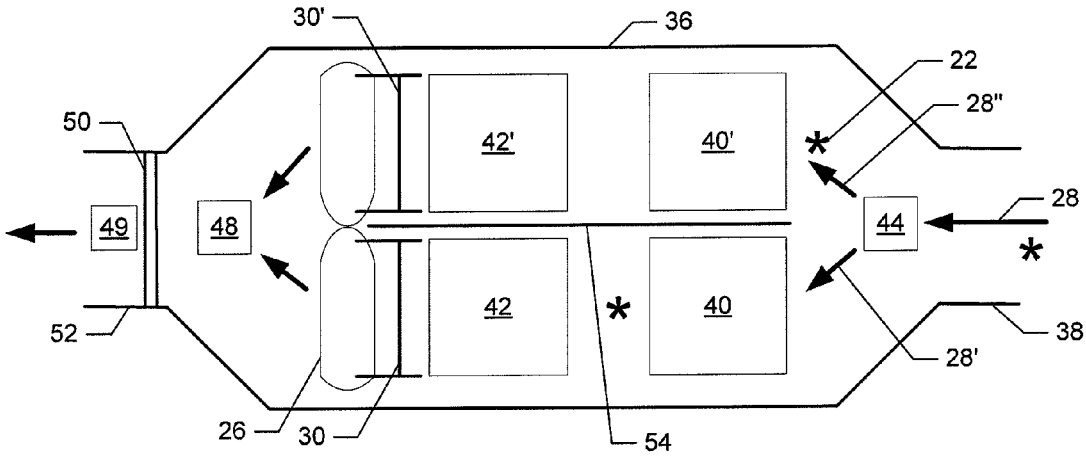
FIG. 2 illustrates a schematic view of a portion of the cleaning apparatus of FIG. 1 wherein the apparatus further comprises a second electrostatic precipitator according to an example embodiment.

FIG. 2 illustrates a top schematic view of a portion of the cleaning apparatus 10 of FIG. 1 wherein the cleaning apparatus further comprises a second electrostatic precipitator 30'. In this embodiment, the second electrostatic precipitator 30' is positioned within the plenum 36. In particular, the second electrostatic precipitator 30' is positioned within the plenum 36 in parallel with the electrostatic precipitator 30 (i.e., the first electrostatic precipitator). In one embodiment, the cleaning apparatus 10 may further comprise a baffle plate 54, or other type of baffle, that is configured to divide the air flow 28 into a first portion 28' and a second portion 28" as the air flow travels through the plenum 36 to the first electrostatic precipitator 30 and the second electrostatic precipitator 30'. The air flow 28 may split and travel through the ionizer 40 (i.e., the first ionizer) and a second ionizer 40' on opposite sides of the baffle plate 54. Thereafter, the first portion 28' and the second portion 28" of the air flow 28 may respectively travel through the collector 42 (i.e., the first collector) and a second collector 42' on opposite sides of the baffle plate 54. Use of the first electrostatic precipitator 30 and the second electrostatic precipitator 30' may provide for increased capacity to remove debris particles 22 as compared to embodiments employing only one electrostatic precipitator.

By configuring the cleaning apparatus 10 with the first electrostatic precipitator 30 and the second electrostatic precipitator 30' positioned in parallel, the overall length of the plenum 36 that contains the first electrostatic precipitator and the second electrostatic precipitator may be reduced as compared to positioning the electrostatic precipitators serially or sequentially. In this regard, the size of the cleaning apparatus 10 may be reduced, which may facilitate use of the cleaning apparatus in certain applications. For example, in circumstances where the cleaning apparatus 10 is used to clean a duct 12 or other structure inside a ship, the size of doors, hatches, and hallways within the ship may prevent usage of cleaning apparatuses that are too large. Further, by separating the air flow 28 downstream of the upstream sensor 44 into the first portion 28' and the second portion 28", and then combining the two portions back into a single air flow stream upstream of the downstream sensor 48, the cleaning apparatus 10 may not require additional sensors to perform the functions described above.

Notwithstanding the above, in applications where the size of the debris collection device is not an issue and where cleaning efficiency is deemed to have a greater importance, two or more electrostatic precipitators may be used in a serial or sequential arrangement. For example, a first ionizer and a first collector may be positioned upstream of a second ionizer and a second collector. In some embodiments, one or more sensor devices may be placed between the electrostatic precipitators and/or after the electrostatic precipitators. Thereby, sensor data may be obtained at various points along the flow path.

Figure 3:
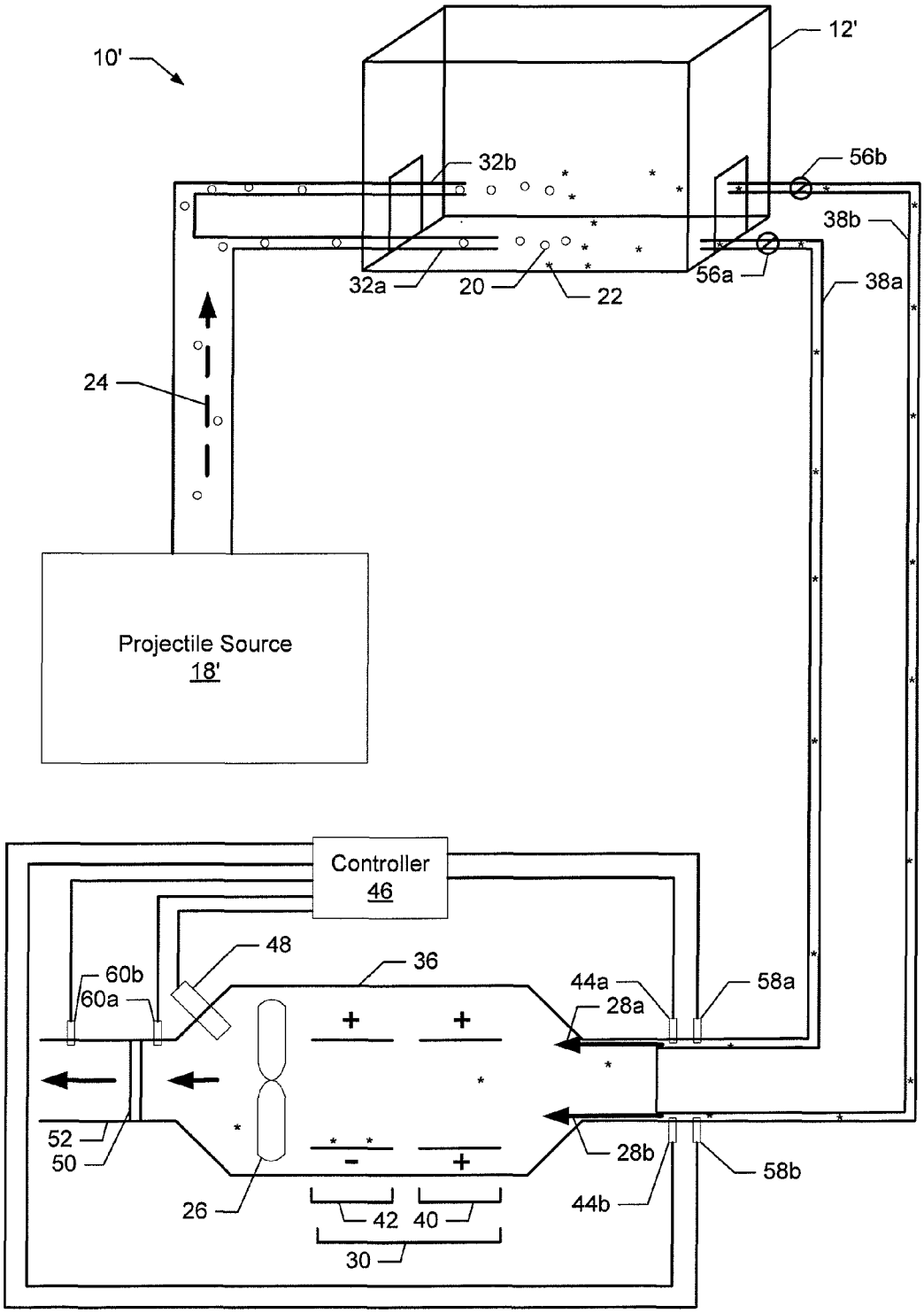
FIG. 3 illustrates a schematic view of an alternate embodiment of a cleaning apparatus comprising carbon dioxide detectors and multiple collection ducts according to an example embodiment.

FIG. 3 illustrates a schematic view of an alternate embodiment of a cleaning apparatus 10'. The cleaning apparatus 10' illustrated in FIG. 3 may comprise many of the same features illustrated in FIG. 1 and described above, and hence overlapping elements and functionality will not be described in detail. However, with regard to differences, the cleaning apparatus 10' is shown in FIG. 3 cleaning a partially enclosed room 12', although various other structures may be cleaned using the cleaning apparatus as described above. In the illustrated embodiment, the projectile source 18' comprises a wand 32*a* (i.e., the first wand) and a second wand 32*b* that direct the projectiles 20 and the flow of pressurized gas 24 into the partially enclosed room 12'. While not required in all embodiments, use of a plurality of wands 32 in some embodiments may allow for cleaning of multiple portions of the enclosed room 12' at the same time, or multiple structures at the same time.

In other embodiments, the cleaning apparatus 10' may also comprise more than one collection conduit 38. For example, the depicted cleaning apparatus 10' comprises a collection conduit 38*a* (i.e., the first collection conduit) and a second collection conduit 38*b*. Use of more than one collection conduit 38 may allow for creation of multiple air flows and the particles 22 may thereby be removed from multiple locations within the same or different structures at the same time. Each collection conduit 38 may include a respective flow source, or a single flow source 26 may be configured to create two or more air flows 28 as shown. Further, one or more of the collection conduits 38 may include a valve 56. In the illustrated embodiment, the first collection conduit 38*a* and the second collection conduit 38*b* respectively include a valve 56*a* (i.e., the first valve) and a second valve 56*b* that may adjust and/or turn on or off an air flow 28*a* (i.e., the first air flow) through the first collection conduit and a second air flow 28*b* through the second collection conduit.

In still another embodiment, the cleaning apparatus 10' may comprise an upstream sensor 44*a* (i.e., the first upstream sensor) and a second upstream sensor 44*b* positioned upstream of the electrostatic precipitator 30 and that respectively produce first and second upstream sensor outputs. As discussed above, the upstream sensor outputs may generally correspond to a quantity, density, or other dislodged debris particle measurement taken respectively from the first air flow 28*a* and the second air flow 28*b* upstream of the electrostatic precipitator. In one embodiment, a user may adjust valves to control the first air flow 28*a* and/or the second air flow 28*b* based on the sensor outputs. For example, if more particles 22 are detected in the second air flow 28*b* than in the first air flow 28*a* (as indicated, for example, by a greater value for the first upstream sensor output), the second valve 56*b* may be opened to maximize the quantity of "dirty air" entering the cleaning apparatus, or vice versa. In some embodiments, the controller 46 may indicate to the user that more particles 22 are detected in one collection conduit 38 than the other, thereby facilitating user-controlled operation of the valves. In other embodiments, the controller 46 may automatically adjust one or more of the valves 56 without user interaction to maximize cleaning performance of the cleaning apparatus.

In other embodiments, a user may additionally or alternatively move the positions of the first collection conduit 38*a* and/or the second collection conduit 38*b* based on the particles 22 detected at one or more upstream sensors. For example, the user may move the collection conduits 38 to positions within the partially enclosed room 12' or other structure at which greater quantities of particles 22 are detected. In this regard, the cleaning efficiency of the cleaning apparatus may be increased.

In still another embodiment, the cleaning apparatus 10' may comprise one or more carbon dioxide detectors. In the illustrated embodiment, a carbon dioxide detector 58*a* (i.e., the first carbon dioxide detector) is configured to produce a carbon dioxide sensor output corresponding to a carbon dioxide level detected in the air flow 28*a* and a second carbon dioxide detector 58*b* is configured to produce a second carbon dioxide sensor output corresponding to a second carbon dioxide level detected in the second air flow 28*b*. Thus, carbon dioxide detectors 58 may detect the carbon dioxide levels in each of the collection conduits 38, and thereby the user may adjust the first air flow 28*a* and/or the second air flow 28*b* using the first valve 56*a* and/or the second valve 56*b* to change the flow through the collection conduits so that more flow occurs through the collection conduit with the greater carbon dioxide concentration.

It may be desirable to remove as much carbon dioxide as possible from the partially enclosed room 12' or other structure. For example, if the first carbon dioxide detector 58*a* detects that the carbon dioxide level in the first collection conduit 38*a* is greater than the second carbon dioxide level in the second collection conduit 38*b*, as detected by the second carbon dioxide detector 58*b*, the user may open the first valve 56*a* to increase the air flow 28*a* through the first collection conduit. In some embodiments, the controller 46 may indicate to the user that the detected carbon dioxide level is greater in one collection conduit 38 than the other, or the controller may automatically adjust one or more of the valves 48 based thereon in some embodiments to maximize carbon dioxide removal. Accordingly, the first air flow 28*a* and/or the second air flow 28*b* may be adjusted based on the carbon dioxide level in the first collection conduit 38*a* and/or the second carbon dioxide level in the second collection conduit 38*b* in order to increase the efficiency of carbon dioxide removal.

However, in some embodiments the carbon dioxide detectors 58 may be positioned in other locations such as proximate the inlets to the collection conduits 38 instead of inside the collection conduits. Positioning the carbon dioxide detectors 58 proximate the inlets to the collection conduits may allow the carbon dioxide detectors to produce outputs relating to carbon dioxide levels that are not affected by changes in flow rates as caused, for example, by adjusting the valves 56.

Accordingly, the carbon dioxide detectors 58 may produce outputs that may more accurately reflect carbon dioxide levels within the structure at the inlets of the collection conduits 38.

In still other embodiments, rather than adjusting valves, the air flow may be adjusted in other manners. For example, in embodiments comprising multiple flow sources, the flow sources may be adjusted to increase flow in the collection conduit where more flow is desired, for example where the carbon dioxide level is greater. The flow rates may be adjusted manually by the user, or in some embodiments the controller may control the flow sources to adjust the flow rates automatically.

Further, the user may additionally or alternatively move the position of the first collection conduit 38*a* and/or the second collection conduit 38*b* based on the first detected carbon dioxide level and/or the second carbon dioxide level. Thereby, for example, the user may move the collection conduits 38 to positions within the partially enclosed room 12' or other structure at which greater levels of carbon dioxide are detected. Accordingly, the efficiency and efficacy of removal of the carbon dioxide may be increased to reduce carbon dioxide build-up in the partially enclosed room 12' or other structure.

FIG. 3 further depicts a cleaning apparatus 10' having a differential pressure sensor 60 of the type described above in accordance with one embodiment. The differential pressure sensor 60 may be configured to detect an upstream pressure upstream of the bypass collector 50 and a downstream pressure downstream of the bypass collector 50. Thereby, for example, the differential pressure sensor may indicate when the upstream pressure exceeds the downstream pressure by more than a predetermined amount. The depicted differential pressure sensor 60 comprises an upstream pressure sensor 60*a* and a downstream pressure sensor 60*b*, which may be electronic pressure sensors. The controller 46 is in electronic communication with the upstream pressure sensor 60*a* and the downstream pressure sensor 60*b*. The controller 46 may be configured to indicate to the user (e.g., via a display or the like) when the upstream pressure exceeds the downstream pressure by a predetermined limit (i.e., perhaps indicating that the bypass collector 50 is clogged or is in need of replacement), and/or the controller may be configured to shut down operation of the cleaning apparatus 10' in such instances. As described above, clogging of the bypass collector 50 may indicate that the electrostatic precipitator 30 needs to be cleaned, and hence, this may be conveyed to the user by the controller 46, for example, through use of a display.

Note that while some features where discussed and shown in the drawings only in terms of use with the cleaning apparatus 10' embodiment depicted in FIG. 3, other embodiments discussed herein may include some of these features. For example, the cleaning apparatus 10 depicted in FIGS. 1 and 2 may include a carbon dioxide sensor configured to determine the quantity or level of carbon dioxide passing through the debris collection device 16. Conversely, some of the features illustrated in connection with the cleaning apparatus 10 of FIGS. 1 and 2 but which are not shown or described in the cleaning apparatus 10' of FIG. 3, may be used in the cleaning apparatus 10' of FIG. 3. For example, the cleaning apparatus 10' of FIG. 3 may comprise a single wand 32, as opposed to two wands 32*a*, 32*b*. Thus, features of the various embodiments of the apparatus may be interchangeable. Further, carbon dioxide sensors may be used in locations other than those shown in the figures. For example, a carbon dioxide sensor may be positioned within or proximate to the structure intended to be cleaned or may be positioned proximate a cleaning technician to ensure that carbon dioxide levels do not reach dangerous levels.

Figure 4A:
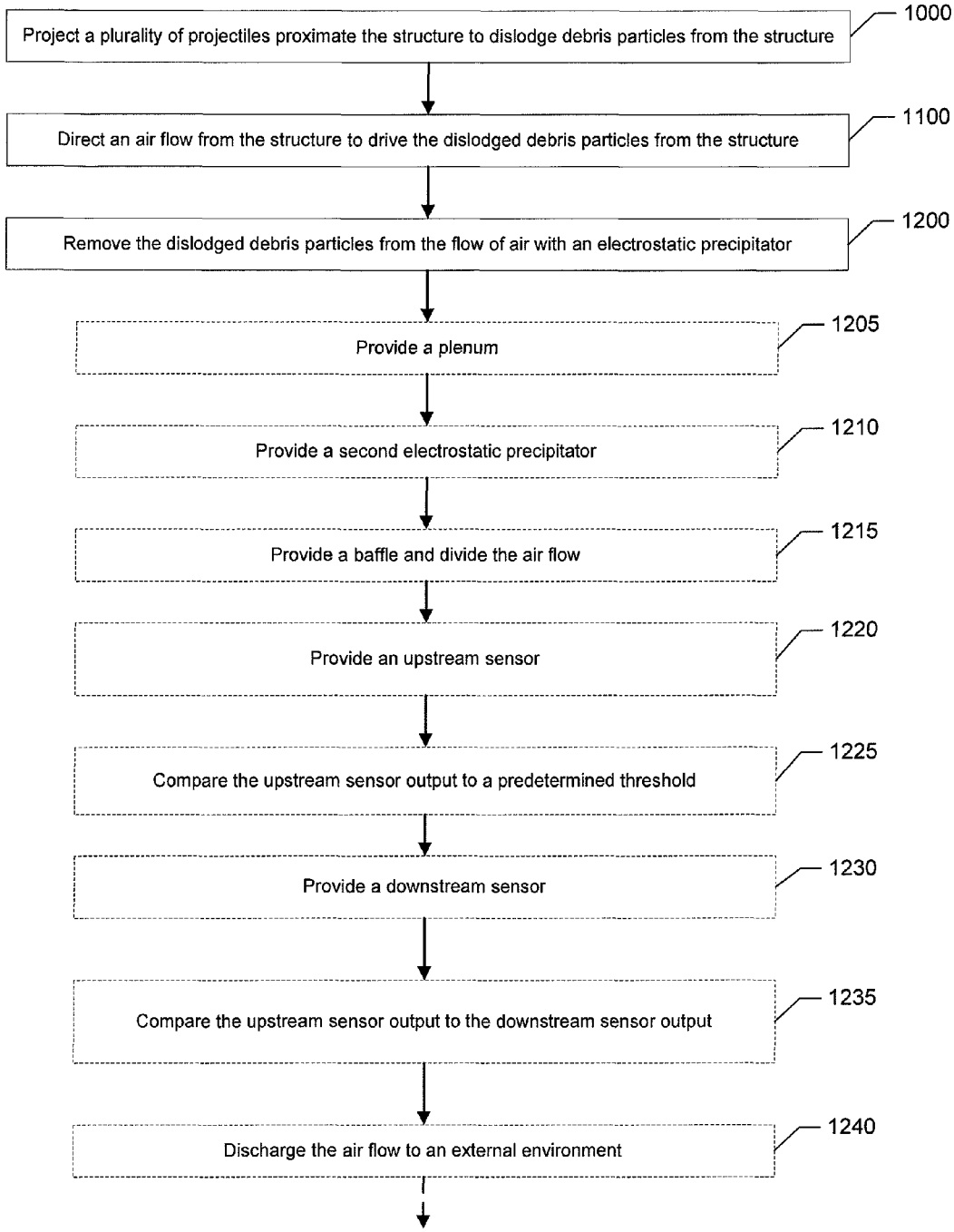
FIGS. 4*a-b* illustrate a flow chart outlining a method of cleaning a structure with an electrostatic precipitator according to an example embodiment.
Figure 4B:
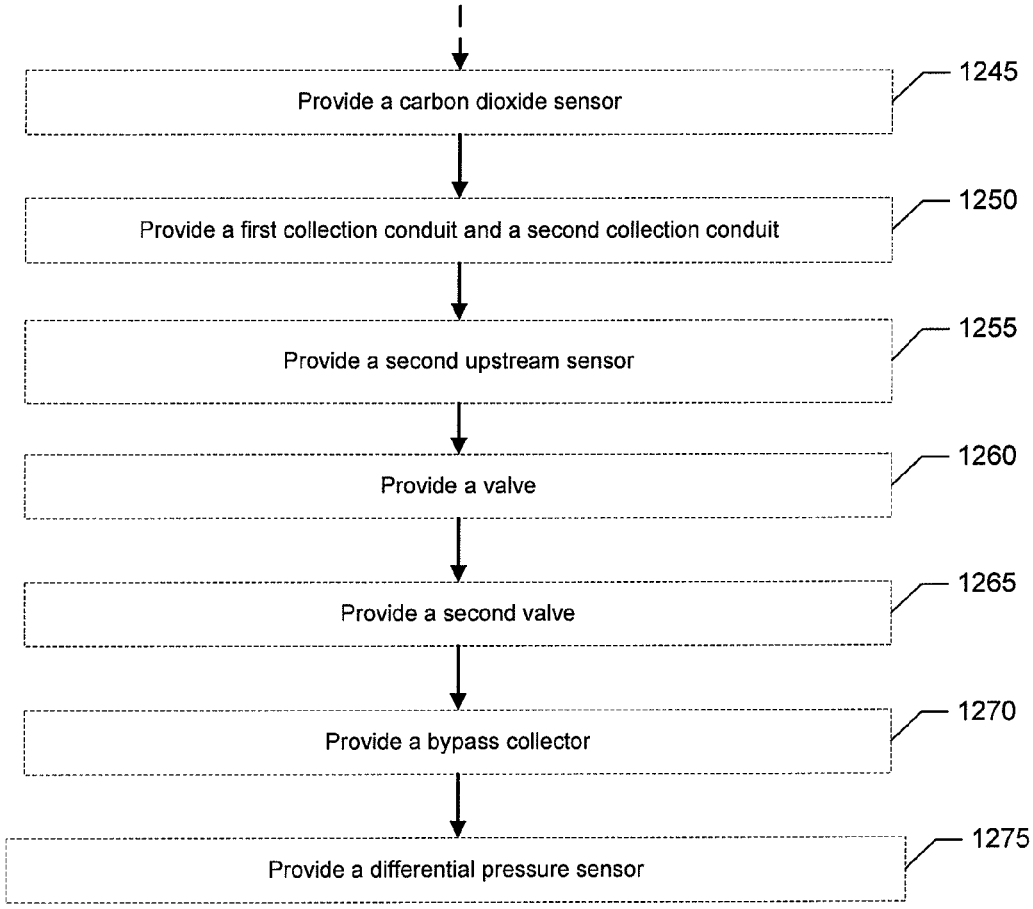

FIGS. 4*a*-*b* depict a method of cleaning a structure in accordance with another embodiment. The method may comprise projecting a plurality of projectiles proximate the structure to dislodge debris particles from the structure at operation 1000. The method may further comprise directing an air flow from the structure to drive the dislodged debris particles from the structure at operation 1100. Additionally, the method may comprise removing the dislodged debris particles from the air flow with an electrostatic precipitator at operation 1200.

In some embodiments, certain ones of the above-described operations (as illustrated in solid lines in FIG. 4*a*) may be modified or further amplified. In some embodiments additional operations may also be included (some examples of which are shown in dashed lines in FIGS. 4*a*-*b*). It should be appreciated that each of the modifications, optional additions or amplifications may be included with the above-described operations (1000-1200) either alone or in combination with any others among the operations described herein. As such, each of the other operations as will be described herein may be combinable with the above-described operations (1000-1200) either alone or with one, more than one, or all of the additional operations in any combination.

In one embodiment, the method comprises providing a plenum that is configured to at least partially enclose the electrostatic precipitator at operation 1205. In another embodiment, the method may comprise providing a second electrostatic precipitator positioned in parallel with the electrostatic precipitator at operation 1210. In such embodiments the plenum may be configured to at least partially enclose the second electrostatic precipitator. The method may also include providing a baffle positioned between the electrostatic precipitator and the second electrostatic precipitator and dividing the air flow with the baffle into a first portion which travels through the electrostatic precipitator and a second portion which travels through the second electrostatic precipitator at operation 1215.

The method may also comprise providing an upstream sensor positioned upstream of the electrostatic precipitator at operation 1220. The upstream sensor may be configured to detect the dislodged debris particles in the air flow upstream of the electrostatic precipitator, and further configured to produce an upstream sensor output based at least in part on the dislodged debris particles detected in the air flow upstream of the electrostatic precipitator. Further, the method may comprise comparing the upstream sensor output to a predetermined threshold at operation 1225. Thereby, for example, it may be possible to tell whether the structure is relatively clean. Additionally, the method may comprise providing a downstream sensor positioned downstream of the electrostatic precipitator at operation 1230, which may in some embodiments be conducted in place of or in addition to the operation 1220 of providing an upstream sensor. The downstream sensor may be configured to detect dislodged debris particles in the air flow downstream of the electrostatic precipitator, and further configured to produce a downstream sensor output based at least in part on the dislodged debris particles detected in the air flow downstream of the electrostatic precipitator. Also, the method may include comparing the upstream sensor output to the downstream sensor output at operation 1235 to thereby determine the efficiency of the electrostatic precipitator. The method may additionally include discharging the air flow to an external environment at operation 1240.

As illustrated in FIG. 4*b*, the method may further comprise providing a carbon dioxide sensor at operation 1245, wherein the carbon dioxide sensor is configured to detect carbon dioxide within the air flow. The method may additionally comprise providing a first collection conduit configured to direct the air flow to the electrostatic precipitator and a second collection conduit configured to direct a second air flow to the electrostatic precipitator at operation 1250. Also, the method may include providing a second upstream sensor positioned upstream of the electrostatic precipitator at operation 1255. The second upstream sensor may be configured to detect dislodged debris particles in the second air flow upstream of the electrostatic precipitator, and further configured to produce a second upstream sensor output based at least in part on the dislodged debris particles detected in the second air flow upstream of the electrostatic precipitator.

Further, the method may include providing a valve at operation 1260, wherein the valve is configured to adjust the air flow. Additionally, the method may comprise providing a second valve at operation 1265, wherein the second valve is configured to adjust the second air flow. For example, the air flow or second air flow may be adjusted based on the upstream sensor output, the second upstream sensor output, or the detected carbon dioxide. The method may further include providing a bypass collector at operation 1270, wherein the bypass collector is configured to indicate presence of the dislodged debris particles downstream of the electrostatic precipitator. The method may also comprise providing a differential pressure sensor proximate the bypass collector at operation 1275. Thereby, it may be determined whether or not the bypass collector is collecting dislodged debris particles bypassing the electrostatic precipitator.

Note that the method and apparatus described herein is generally described with regard to cleaning a duct or partially enclosed room. However, as noted above, various other types of ducts, structures, and equipment may be cleaned using the cleaning apparatus. For example, on a ship intake ducts, recirculation ducts, discharge ducts, and other structures may be cleaned. Discharge ducts and open outdoor structures may in some embodiments be cleaned without collecting the particles. In this regard, the dislodged debris particles and carbon dioxide produced from dry ice pellets may blow away in the ambient air or otherwise be discharged from the ship. Thus, carbon dioxide levels may not reach high concentrations and the dislodged debris particles may also blow away. However, in some embodiments collection of the particles may still be desirable. For example, when using the cleaning apparatus to remove mold or paint containing lead, it may be desirable to collect the particles. Thus, use of an electrostatic precipitator may still occur. Further, it may be desirable to vent carbon dioxide gas produced from dry ice pellets to an exterior environment. For example, it may be desirable to remove carbon dioxide from intake ducts, recirculation ducts, and other partially or fully enclosed structures in order to prevent build-up of carbon dioxide within the structures.

Many modifications and other embodiments of the embodiments of the invention set forth herein will come to mind to one skilled in the art to which the invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A cleaning apparatus configured to clean debris particles from a structure, comprising:

a projectile source configured to project a plurality of projectiles proximate the structure to dislodge debris particles from the structure;

a flow source configured to create an air flow for driving the dislodged debris particles from the structure;

an electrostatic precipitator configured to remove the dislodged debris particles from the air flow;

a carbon dioxide detector that detects carbon dioxide within the air flow and generates an output relating to the detected carbon dioxide; and a controller that calculates a carbon dioxide concentration in response to receiving the output relating to the detected carbon dioxide.

2. The cleaning apparatus of claim 1, further comprising an upstream sensor positioned upstream of the electrostatic precipitator, wherein the upstream sensor is configured to detect dislodged debris particles in the air flow upstream of the electrostatic precipitator, and is further configured to produce an upstream sensor output based at least in part on the dislodged debris particles detected in the air flow upstream of the electrostatic precipitator.

3. The cleaning apparatus of claim 2, wherein the controller is further configured to compare the upstream sensor output to a predetermined threshold.

4. The cleaning apparatus of claim 2, further comprising:

a downstream sensor positioned downstream of the electrostatic precipitator, wherein the downstream sensor is configured to detect dislodged debris particles in the air flow downstream of the electrostatic precipitator, and is further configured to produce a downstream sensor output based at least in part on the dislodged debris particles detected in the air flow downstream of the electrostatic precipitator; and wherein the controller is further configured to compare the upstream sensor output to the downstream sensor output.

5. The cleaning apparatus of claim 2, further comprising:

a first collection conduit configured to direct the air flow to the electrostatic precipitator; and a second collection conduit configured to direct a second air flow to the electrostatic precipitator.

6. The cleaning apparatus of claim 5, further comprising a second upstream sensor positioned upstream of the electrostatic precipitator, wherein the second upstream sensor is configured to detect dislodged debris particles in the second air flow upstream of the electrostatic precipitator, and is further configured to produce a second upstream sensor output based at least in part on the dislodged debris particles detected in the second air flow upstream of the electrostatic precipitator.

7. The cleaning apparatus of claim 5, further comprising a valve configured to adjust the air flow.

8. The cleaning apparatus of claim 7, further comprising a second valve configured to adjust the second air flow.

9. The cleaning apparatus of claim 5, wherein the carbon dioxide detector is a first carbon dioxide detector, the apparatus further comprising a second carbon dioxide detector, wherein the first carbon dioxide detector is positioned to detect a carbon dioxide level in the first air flow and the second carbon dioxide detector is positioned to detect a carbon dioxide level in the second air flow.

10. The cleaning apparatus of claim 9, further comprising a first valve configured to adjust the first air flow in the first conduit and a second valve configured to adjust the second air flow in the second conduit.

11. The cleaning apparatus of claim 10, wherein the controller is further configured to adjust the first valve to increase the first air flow in response to a detected carbon dioxide level at the first carbon dioxide sensor being greater than a detected carbon dioxide level at the second carbon dioxide sensor.

12. The cleaning apparatus of claim 10, wherein the controller is further configured to adjust a flow rate from the flow source, wherein the controller is configured to increase a flow rate of the first air flow in response to a detected carbon dioxide level at the first carbon dioxide sensor being greater than a detected carbon dioxide level at the second carbon dioxide sensor.

13. The cleaning apparatus of claim 9, wherein the first carbon dioxide detector is positioned at an inlet to the first conduit and the second carbon dioxide detector is positioned at an inlet to the second conduit.

14. The cleaning apparatus of claim 1, further comprising a downstream sensor positioned downstream of the electrostatic precipitator, wherein the downstream sensor is configured to detect dislodged debris particles in the air flow downstream of the electrostatic precipitator, and is further configured to produce a downstream sensor output based at least in part on the dislodged debris particles detected in the air flow downstream of the electrostatic precipitator.

15. The cleaning apparatus of claim 1, wherein the plurality of projectiles comprise a plurality of dry ice pellets.

16. The cleaning apparatus of claim 1, wherein the structure comprises a duct.

17. The cleaning apparatus of claim 1, further comprising a plenum that at least partially encloses the electrostatic precipitator.

18. The cleaning apparatus of claim 17, wherein the flow source is positioned within the plenum.

19. The cleaning apparatus of claim 17, further comprising a second electrostatic precipitator positioned in parallel with the electrostatic precipitator, wherein the plenum at least partially encloses the second electrostatic precipitator.

20. The cleaning apparatus of claim 19, further comprising a baffle positioned between the electrostatic precipitator and the second electrostatic precipitator, wherein the baffle is configured to divide the air flow into a first portion which travels through the electrostatic precipitator and a second portion which travels through the second electrostatic precipitator.

21. The cleaning apparatus of claim 1, further comprising a discharge conduit in fluid communication with the electrostatic precipitator, wherein the discharge conduit is configured to discharge the air flow to an external environment.

22. The cleaning apparatus of claim 1, further comprising a bypass collector positioned downstream of the electrostatic precipitator.

23. The cleaning apparatus of claim 22, further comprising a differential pressure sensor positioned proximate the bypass collector.

24. The cleaning apparatus of claim 1, further comprising a flow sensor that detects a flow through the cleaning apparatus and generates an output related to the detected flow, wherein the controller calculates the carbon dioxide concentration by comparing the output relating to the detected carbon dioxide to the output related to the detected flow.

25. A cleaning apparatus configured to clean debris particles from a structure, comprising:

a projectile source configured to project a plurality of dry ice pellets proximate the structure to dislodge debris particles from the structure;

a flow source configured to create an air flow for driving the dislodged debris particles from the structure;

an electrostatic precipitator configured to remove the dislodged debris particles from the air flow;

a carbon dioxide detector that detects carbon dioxide within the air flow and generates an output relating to the detected carbon dioxide; and a controller that calculates a carbon dioxide concentration in response to receiving the output relating to the detected carbon dioxide.

26. The cleaning apparatus of claim 25, further comprising:

a first collection conduit configured to direct the air flow to the electrostatic precipitator; and a second collection conduit configured to direct a second air flow to the electrostatic precipitator.

27. The cleaning apparatus of claim 26, wherein the carbon dioxide detector is a first carbon dioxide detector, the apparatus further comprising a second carbon dioxide detector, wherein the first carbon dioxide detector is positioned to detect a carbon dioxide level in the first air flow and the second carbon dioxide detector is positioned to detect a carbon dioxide level in the second air flow.

28. The cleaning apparatus of claim 27, further comprising a first valve configured to adjust the first air flow in the first conduit and a second valve configured to adjust the second air flow in the second conduit.

29. The cleaning apparatus of claim 28, wherein the controller is further configured to adjust the first valve to increase the first air flow in response to a detected carbon dioxide level at the first carbon dioxide sensor being greater than a detected carbon dioxide level at the second carbon dioxide sensor.

30. The cleaning apparatus of claim 28, wherein the controller is further configured to adjust a flow rate from the flow source, wherein the controller is configured to increase a flow rate of the first air flow in response to a detected carbon dioxide level at the first carbon dioxide sensor being greater than a detected carbon dioxide level at the second carbon dioxide sensor.

31. The cleaning apparatus of claim 27, wherein the first carbon dioxide detector is positioned at an inlet to the first conduit and the second carbon dioxide detector is positioned at an inlet to the second conduit.

* * * * *